US009427130B2

(12) United States Patent
Gibis et al.

(10) Patent No.: US 9,427,130 B2
(45) Date of Patent: Aug. 30, 2016

(54) MOP

(75) Inventors: Karl-Ludwig Gibis, Limburgerhof (DE); Norbert Weis, Weinheim (DE); Dieter Philipp, Schriesheim (DE); Lars Schmitt, Viernheim (DE)

(73) Assignee: Carl Freudenberg KG, Weinheim (DE)

( * ) Notice: Subject to any disclaimer, the term of this patent is extended or adjusted under 35 U.S.C. 154(b) by 485 days.

(21) Appl. No.: 13/992,612

(22) PCT Filed: Oct. 17, 2011

(86) PCT No.: PCT/EP2011/005199
§ 371 (c)(1),
(2), (4) Date: Jul. 16, 2013

(87) PCT Pub. No.: WO2012/076075
PCT Pub. Date: Jun. 14, 2012

(65) Prior Publication Data

US 2013/0283558 A1 Oct. 31, 2013

(30) Foreign Application Priority Data

Dec. 9, 2010 (DE) ..... 10 2010 054 010

(51) Int. Cl.
*A47L 13/24* (2006.01)
*A47L 13/20* (2006.01)
*A47L 13/255* (2006.01)

(52) U.S. Cl.
CPC ..... *A47L 13/24* (2013.01); *A47L 13/20* (2013.01); *A47L 13/255* (2013.01)

(58) Field of Classification Search
CPC ..... A47L 13/20; A47L 13/255; A47L 13/38; A47L 13/46; A47L 13/16; A47L 13/24; A47L 13/256; A47L 13/252; A47L 13/58
See application file for complete search history.

(56) References Cited

U.S. PATENT DOCUMENTS

| | | | | |
|---|---|---|---|---|
| 5,725,927 | A * | 3/1998 | Zilg et al. | 428/89 |
| 6,161,242 | A * | 12/2000 | Cabrero Gomez et al. | 15/147.1 |
| 6,921,570 | B2 * | 7/2005 | Belau et al. | 428/103 |
| 2005/0241095 | A1 * | 11/2005 | Olson | 15/228 |
| 2006/0123573 | A1 | 6/2006 | Rivera et al. | |

FOREIGN PATENT DOCUMENTS

| | | | |
|---|---|---|---|
| CA | 2644519 | A1 | 9/2007 |
| CA | 2820110 | A1 | 6/2012 |
| CN | 101400290 | A | 4/2009 |
| DE | 43 22 871 | A1 | 1/1995 |
| DE | 195 18 975 | C1 | 6/1996 |
| DE | 10 2010 054 010 | B4 | 3/2014 |

(Continued)

*Primary Examiner* — Robert Scruggs
(74) *Attorney, Agent, or Firm* — Leydig, Voit & Mayer, Ltd.

(57) ABSTRACT

A mop comprising a mop head (1) that has at least one cleaning strip (2) is disclosed. The cleaning strip (2) comprises at least one cleaning surface (5) on which raised cleaning islands (6) made of flock fibers are arranged. The cleaning strip (2) is attached to the mop head (1) at one of its ends (3) and has a free end (4). The raised cleaning islands (6) on the at least one cleaning surface (5) of the cleaning strip (2) are arranged at certain distances (7) from each other and are surrounded on all sides by storage spaces (8) for holding dirt. The size of the storage spaces (8) steadily decreases from the end (3) of the cleaning surface (5) facing the mop head (1) in the mopping direction (9) of the free end (4).

20 Claims, 2 Drawing Sheets

(56) References Cited

FOREIGN PATENT DOCUMENTS

| | | | |
|---|---|---|---|
| EP | 0 632 990 | B1 | 1/1995 |
| EP | 2 347 691 | A1 | 7/2011 |
| WO | WO 2007/100497 | A1 | 9/2007 |
| WO | WO 2007/101518 | A1 | 9/2007 |

* cited by examiner

MOP

CROSS-REFERENCE TO RELATED APPLICATIONS

This patent application is the national phase of PCT/EP2011/005199, filed Oct. 17, 2011 which claims the benefit of German Patent Application No. 10 2010 054 010.2, filed Dec. 9, 2010.

FIELD OF THE INVENTION

The invention concerns a mop including a mop head with at least one cleaning strip, which is attached at one end to the mop head and which has a free end. The cleaning strip has at least one cleaning surface, on which raised cleaning islands are disposed at distances from each other, the cleaning islands being surrounded on all sides by storage spaces for holding soil.

BACKGROUND OF THE INVENTION

A mop such as generally described above is known. The cleaning surface of the mop has congruently shaped cleaning islands that are uniformly distributed. Congruently shaped storage spaces for holding soil are disposed around the cleaning islands.

However, it may be observed that the soil particles that are removed from the surface that is being cleaned have different sizes. Soil particles of different sizes cannot be held very effectively by the congruently shaped cleaning islands and the congruently shaped storage spaces. For example, larger soil particles, such as long hairs, cannot be held in small storage spaces, while fine dust is retained in large storage spaces. In each of these cases the cleaning result is not very satisfactory.

SUMMARY OF THE INVENTION

A general object of the invention is to provide an improved mop of the kind described above that enables soil particles of different sizes to be efficiently removed from the surface being cleaned and held and retained in the storage spaces.

To this end, the storage spaces may be configured such that they become steadily smaller starting from the end of the cleaning surface facing the mop head in the direction of mopping of the free end. Advantageously, when mopping a surface, larger soil particles, for example, long hairs, can be first held in the large storage spaces that lie at the front relatively closer to the mop head. Smaller soil particles, for example, dust, pass by the larger storage spaces largely unhindered and arrive at the smaller storage spaces that lie farther back in the direction of mopping. The smaller soil particles accumulate in these smaller storage spaces that are disposed relatively closer to the free end. The smallest soil particles, for example, very fine dust, pass by even these storage spaces and are held either in the smallest storage spaces or in the cleaning islands themselves. One mop is thus suitable for removing and holding soil particles of different sizes from a surface to be cleaned, thereby producing an especially good cleaning result.

The storage spaces that are adjacent to each other in a direction transverse to the direction of mopping can have a uniform size. As a result, the production of the mop is simple from the standpoint of manufacturing technology and is less costly with regard to economics.

To achieve a steady decrease in size of the storage spaces in the direction of mopping of the free end of the at least one cleaning strip, the cleaning islands can be configured so as to be steadily larger starting from the end of the cleaning surface facing the mop head in the direction of mopping of the free end. Advantageously, for holding very small soil particles (e.g., fine dust particles) large cleaning islands that bind the fine dust particles are provided in addition to the small storage spaces that surround the large cleaning islands.

In order to do a good job of mopping large, evenly soiled surfaces with uniform cleaning results in the direction of mopping, only the cleaning islands adjacent to each other in a direction transverse to the direction of mopping can be configured to have a uniform size. Through this, practically the same hitherto described effect is achieved as in the design in which the storage spaces adjacent to each other in the direction transverse to the direction of mopping have a uniform size.

The cleaning surface can have, in the area of the free end of the cleaning strip, only one central cleaning island disposed centrally in a direction transverse to the direction of mopping on the cleaning surface. The central island can be surrounded in a substantially arc shape by other cleaning islands in the direction of the mop head.

The radial distances between the adjacent cleaning islands can become steadily larger starting from the central cleaning island in the direction against or opposite the direction of mopping, thus in the direction of or towards the mop head. The direction of mopping extends in the radial direction relative to the central cleaning island. Even in the case of mopping movements in the form of a figure eight, as is conventional in cleaning with a mop, this arrangement results in the storage spaces lying around the central cleaning island being smaller than the storage spaces disposed radially further along in the direction of or towards the mop head.

Each of the cleaning islands and/or the central cleaning island can be configured substantially round. This can permit soil particles to easily pass by the islands without remaining attached to them. Attachment of the soil particles to the islands can prevent flow in the direction of or towards the free end/smaller storage spaces.

The cleaning islands disposed adjacent to each other in the direction transverse to the direction of mopping can form an island row, where the cleaning islands of the island row are staggered in the gaps between the cleaning islands of the adjacent island row in the direction of mopping. If the size of the cleaning islands is appropriately matched, this arrangement with the cleaning islands that are adjacent in the direction of mopping in gaps ensures that no un-mopped strips will remain even with a single pass of the mop over a surface to be cleaned.

The distances and/or the radial distances between the adjacent cleaning islands can be 0.1 mm to 50 mm. Such distances are advantageous in order to form storage spaces that are well suited for holding ordinary household soil.

The cleaning islands can cover 1% to 80% of the cleaning surface. More preferably, the cleaning islands can cover 5% to 50% of the cleaning surface. Coverage of up to 50% is sufficient for most uses. Such a design is advantageous because the material of which the cleaning islands are made is frequently costly. With such a configuration the cleaning device can be made relatively cheaply.

The cleaning islands can comprise flock fibers. Using flock fibers can produce a good cleaning performance. However, the flocking of carrier materials with flock fibers is expensive in comparison with the carrier material itself. A large portion of the costs for flocking is made up of the materials themselves, i.e., the flock fibers and the adhesive that is needed to affix the flock fibers to the carrier material. In combination with the arrangement of the storage spaces and the cleaning islands, only a comparably small amount of flock fibers is needed to achieve good cleaning performance, so the cleaning device can be made cheaply.

The flock fibers of each cleaning island can have different lengths and can be disposed substantially perpendicular to the cleaning surface. For example, a cleaning island can have flock fibers with only two different lengths. The lengths can be, for example, 1 mm and 3 mm. This arrangement provides an additional possibility of a three-dimensional structure for soil removal and soil accommodation. Each cleaning island thus has a more highly structured surface. It was found that when flock fibers of these lengths are used, standard household soil is picked up on average 23% better than when using a cleaning device that has cleaning islands with flock fibers of the same length.

The flock fibers of different lengths can be substantially homogeneously distributed for formation of the cleaning island.

The flock fibers of a cleaning island can be formed by viscose fibers and/or polyamide fibers. It is advantageous for the cleaning islands to retain their three-dimensional flocking structure even during wet mopping. A flock fiber mixture of viscose and polyamide has good water absorbency properties. The water absorbent viscose fibers would, without the additional use of fibers with a support effect, for example, polyamide fibers, lie against the carrier material in a wet state, in which the pronounced three-dimensional structure of the flocking would be lost. Flock fibers of polyamide, and also polypropylene or polyethylene, absorb only small amounts of water and thus remain in their perpendicular position standing out from the surface of the cleaning strip. Accordingly, these kinds of fibers provide a support structure for the viscose fibers, with a fraction of support fibers of ≥20% with respect to the viscose fibers being able to provide this support function. Depending on the particular application, especially how the surface to be cleaned is made and of what material it consists, and further depending on what kind of soil is supposed to be removed and held by the cleaning device, an advantageous for a mixture ratio of viscose fibers to polyamide fibers per cleaning island was found to be 80:20 to 20:80.

The cleaning strip also can be flocked with the flock fibers. Preferably, the cleaning strip consists of a nonwoven material. The flocking of the cleaning strip with flock fibers can, for example, take place electrostatically. The flock fibers can be attached generally perpendicularly relative to the cleaning strip material, with one end of the fibers being in an adhesive layer. With this configuration, the cleaning strip with the flocked fibers has a three-dimensional structure and an increase in surface area. This increase in surface area can permit soil to be removed from the cleaned surface and held in the storage spaces especially well both in dry mopping and in wet mopping. Electrostatic flocking has the advantage that it achieves a high flocking density. The coverage of the cleaning strip by the cleaning islands should not exceed 80% in order to achieve a sufficient three-dimensionality of the surface structure and to keep the production costs of the mop as low as possible.

BRIEF DESCRIPTION OF THE DRAWINGS

An exemplary embodiment of a mop in accordance with the invention is described below in more detail with reference to FIGS. 1 and 2.

DETAILED DESCRIPTION OF THE INVENTION

Figure 1:
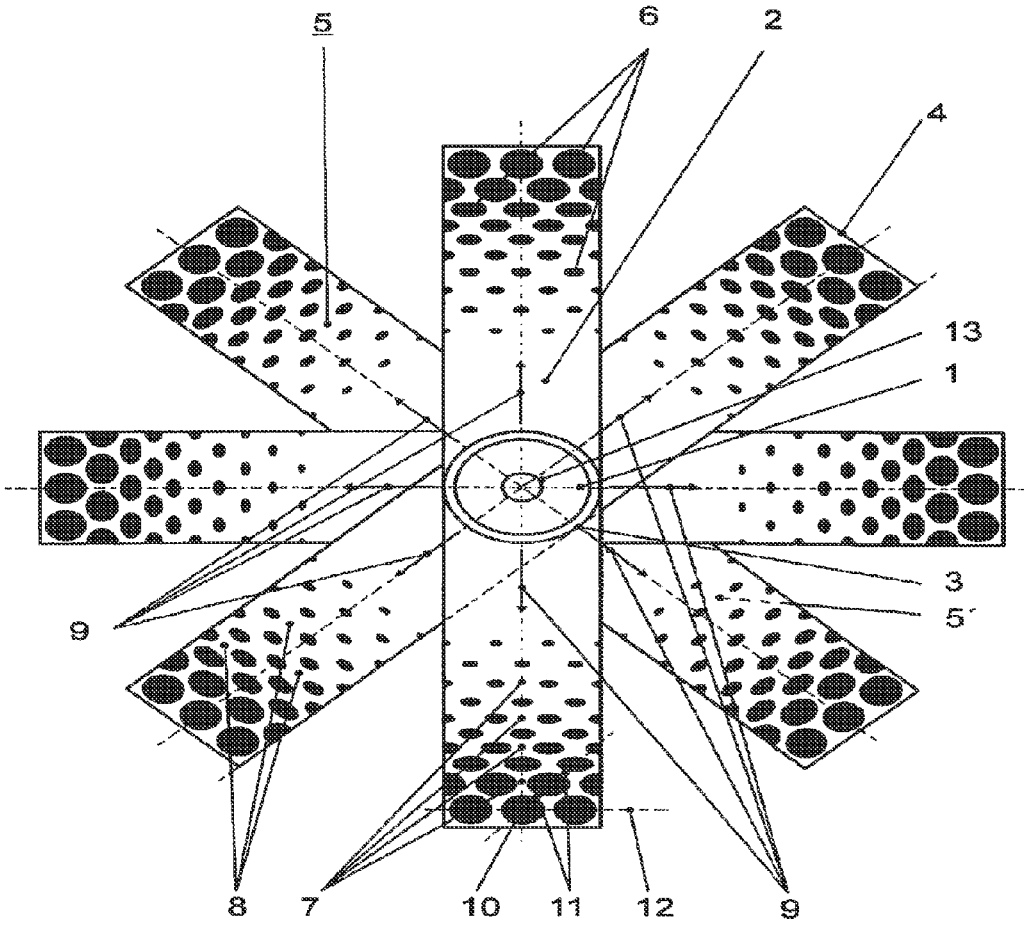
FIG. 1 is a schematic plan view of a mop with fanned out cleaning strips.
Figure 2:
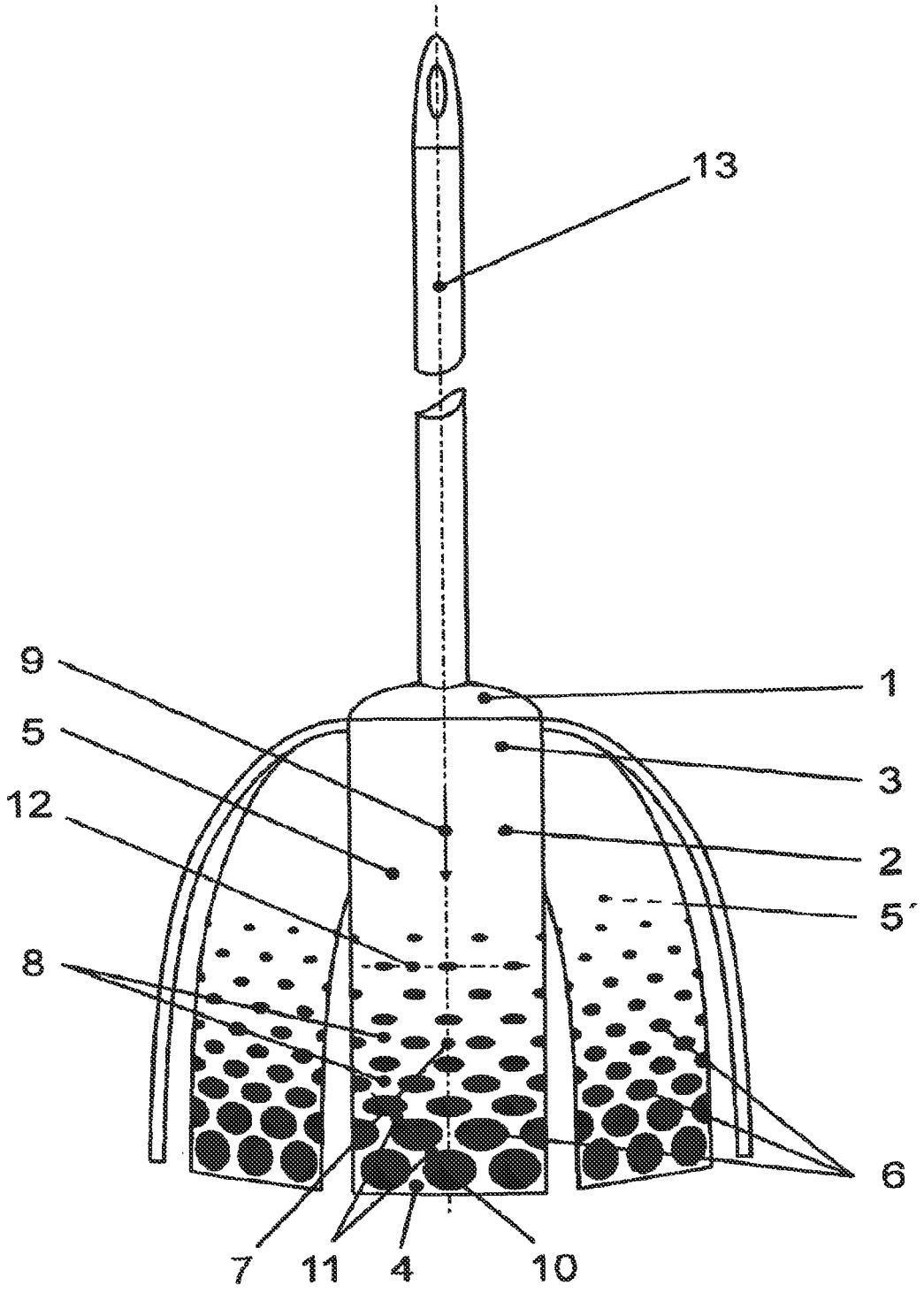
FIG. 2 is a schematic top view of the mop of FIG. 1.

FIGS. 1 and 2 show an exemplary embodiment of a mop. The mop includes a mop head 1, which, in the illustrated embodiment, has eight cleaning strips 2. The cleaning strips 2 lying opposite each other in the radial direction of the mop head 1 can be made in one piece by merging into each other. The cleaning strips 2 are attached by their ends 3 to the mop head 1. The illustrated cleaning strips 2 have two congruently shaped cleaning surfaces 5 opposite each other. This results in both cleaning surfaces 5 of each cleaning strip 2 having the same advantageous user properties; even if one cleaning strip turns over during the proper use of the mop, the cleaning is not adversely affected.

The cleaning islands 6 on the cleaning strips 2 are in each case spaced a distance 7 relative to each other. The cleaning islands 6 are surrounded on all sides by storage spaces 8 for holding soil particles. The distances 7 between the adjacent cleaning islands 6 in the illustrated embodiment are between 0.1 mm and 50 mm, with the cleaning islands 6 covering about 50% of the cleaning surface 5.

The cleaning islands 6 include flock fibers. The flock fibers of each individual island row 12 have different lengths in order to be able to make additional surface area available for holding soil particles. In the illustrated embodiment, the flock fibers of each cleaning island 6 include viscose fibers and polyamide fibers, where the mixture ratio per cleaning island 6 is about 50:50.

In the illustrated embodiment, the cleaning strips 2 are congruently shaped. Generally, however, the cleaning strips 2 could also be different from each other, for example by varying the size and/or the shape of the cleaning islands 6 and/or the storage spaces 5 from cleaning strip 2 to cleaning strip 2.

In the illustrated embodiment, the storage spaces 5 become steadily smaller starting from the end 3 of the cleaning surface 5 facing the mop head 1 in the mopping direction 9 of the free end 4. Also, the cleaning islands 6 become steadily larger in the mopping direction 9 of the free end 4 starting from the end 3 of the cleaning surface 5 facing the mop head 1.

As the mop is moved in the mopping direction 9, coarse soil particles like hairs or crumbs first reach the large storage spaces 8, and finer soil particles like dust or pollen pass by the larger storage spaces 8 defined by the smaller cleaning islands 6 and are held in the smaller storage spaces 8. Fine dust particles can be held not only in the smallest storage spaces 8, but also in the cleaning islands 6 themselves.

Several cleaning islands 6 are disposed adjacent to each other in the direction transverse to the direction of mopping 9 so as to form an island row 12. Several island rows 12 are adjacent to each other and extend transverse to the direction of mopping 9, with the cleaning islands 6 of each island row 12 being staggered in the gaps between the cleaning islands 6 of the adjacent island row 12 in the mopping direction 9. With this arrangement, when mopping in the mopping direction 9, no un-mopped strips remain on the surface that is to be cleaned (not shown).

As already stated, the reverse cleaning surface 5 of the cleaning strip 2 can also be flocked with flock fibers like the front side of the cleaning surface 5.

FIG. 1 provides a schematic plan view of a mop with fanned out cleaning strips 2, where the cleaning strips 2 are attached by one end 3 to the mop head 1. The cleaning islands 6, which border the storage spaces 8, are disposed on the portion of the cleaning strips that extend in the direction of the free end 4.

In FIG. 2, the mop from FIG. 1 is shown in a schematic top view. The mop has a handle 13, which is joined to the mop head 1. In the illustrated embodiment, the cleaning strips 2 are disposed in a bell shape along the circumference of the mop head 1.

The invention clamed is:

1. A mop comprising:

a mop head with at least one cleaning strip, the at least one cleaning strip having at least one cleaning surface on which a plurality of raised cleaning islands of flock fibers are disposed;

wherein the at least one cleaning strip has a first end attached to the mop head and a second free end;

wherein the plurality of raised cleaning islands are disposed in spaced relation to each other with each cleaning island being surrounded by storage spaces for accommodation of soil, the storage spaces becoming steadily smaller in a direction of mopping from the first end to the second free end.

2. The mop as in claim 1, wherein the cleaning islands are arranged in a plurality of rows each extending in a direction transverse to the direction of mopping and wherein the storage spaces adjacent to each other in the direction transverse to the direction of mopping have a uniform size.

3. The mop as in claim 1, wherein the cleaning islands become continuously larger in the direction of mopping starting from the first end of the cleaning surface and extending toward the second free end of the cleaning surface.

4. The mop as in claim 1, wherein the cleaning islands are arranged in a plurality of rows extending in a direction transverse to the direction of mopping and wherein the cleaning islands that are adjacent to each other in the direction transverse to the direction of mopping have a uniform size.

5. The mop as in claim 1, wherein one of the plurality of cleaning islands is a central cleaning island that is arranged near the free end of the cleaning strip, the central cleaning island being disposed transverse to the direction of mopping in the middle of the cleaning surface, the central cleaning island being surrounded by others of the plurality of cleaning islands that are arranged in a substantially arc shaped configuration relative to the central cleaning island in a direction towards the mop head.

6. The mop as in claim 5, wherein adjacent cleaning islands are spaced a radial distance from each other that becomes steadily larger in a direction opposite the direction of mopping, starting from the central cleaning island.

7. The mop as in claim 5, wherein the cleaning islands each have a substantially round configuration.

8. The mop as in claim 1, wherein the cleaning islands are arranged in a plurality of rows with each row extending in a direction transverse to the direction of mopping, wherein the cleaning islands of each row are staggered in gaps between the cleaning islands of the adjacent row in the direction of mopping.

9. The mop as claim 1, wherein the cleaning islands are spaced 0.1 mm to 50 mm from each other.

10. The mop as in claim 1, wherein the cleaning islands cover 1% to 80% of the cleaning surface.

11. The mop as in claim 1, wherein the cleaning islands cover 5% to 50% of the cleaning surface.

12. The mop as in claim 1, wherein the cleaning islands include flock fibers.

13. The mop as in claim 12, wherein at least some of the flock fibers of each cleaning island have different lengths and wherein the flock fibers of each cleaning island are attached in substantially perpendicular relation to the cleaning surface.

14. The mop as in claim 13, wherein the flock fibers of different lengths are distributed substantially homogeneously throughout each cleaning island.

15. The mop as in claim 12, wherein each cleaning island has flock fibers that are approximately 1 mm in length and flock fibers that are approximately 3 mm in length.

16. The mop as claim 12, wherein the flock fibers of each cleaning island include viscose fibers and polyamide fibers.

17. The mop as in claim 16, wherein the mixture ratio of viscose fibers to polyamide fibers of each cleaning island is between 80 to 20 and 20 to 80.

18. The mop as in claim 1, wherein the cleaning strip is flocked with flock fibers.

19. The mop as in claim 1, wherein the cleaning strip comprises a nonwoven material.

20. The mop as in claim 1, wherein the cleaning strip has two congruently shaped cleaning surfaces that are arranged opposite each other.

* * * * *